US009833058B2

(12) United States Patent
Bryant

(10) Patent No.: US 9,833,058 B2
(45) Date of Patent: Dec. 5, 2017

(54) ELECTRONIC DEVICE HARNESS ASSEMBLY

(71) Applicant: Chester Bryant, Chicago, IL (US)

(72) Inventor: Chester Bryant, Chicago, IL (US)

( * ) Notice: Subject to any disclaimer, the term of this patent is extended or adjusted under 35 U.S.C. 154(b) by 0 days.

(21) Appl. No.: 15/087,028

(22) Filed: Mar. 31, 2016

(65) Prior Publication Data

US 2017/0280861 A1 Oct. 5, 2017

(51) Int. Cl.
*A45F 5/00* (2006.01)

(52) U.S. Cl.
CPC ..... *A45F 5/00* (2013.01)

(58) Field of Classification Search
CPC F16M 13/04; F16M 13/00; A45F 5/00; A45F 2200/0525; A45F 2200/0516
See application file for complete search history.

(56) References Cited

U.S. PATENT DOCUMENTS 607,496 A * 7/1898 Watson ..... A47B 23/002 248/444
2,603,134 A * 7/1952 Burnam ..... F16M 13/04 224/185
2,861,854 A * 11/1958 Best ..... A47B 23/002 108/135
4,526,308 A * 7/1985 Dovey ..... F16M 13/04 224/185
4,715,293 A * 12/1987 Cobbs ..... A47B 23/002 108/43
5,421,499 A * 6/1995 Bauer ..... A47B 23/002 108/43
5,806,734 A * 9/1998 Scott ..... F16M 13/04 224/255
D558,974 S 1/2008 Denzer et al.
8,418,900 B1 * 4/2013 Baker ..... A45F 5/00 224/262
8,505,790 B2 8/2013 Yu et al.
8,807,406 B1 8/2014 Thach
8,881,961 B1 11/2014 Cibirka
2007/0164987 A1 7/2007 Graham
2010/0025444 A1 * 2/2010 Tipton ..... A45F 5/00 224/576
2011/0297720 A1 * 12/2011 Yu ..... A45F 3/10 224/623
2011/0315733 A1 * 12/2011 White ..... A45F 5/00 224/600
2013/0072266 A1 3/2013 Shattuck et al.
2013/0214022 A1 8/2013 Harvey

FOREIGN PATENT DOCUMENTS

WO WO2011010203 1/2011

* cited by examiner

*Primary Examiner* — Corey Skurdal

(57) ABSTRACT

An electronic device harness assembly includes a yoke that may be placed around a neck of a user. A harness is movably coupled to the yoke. The harness may be positioned on a chest of the user when the yoke is worn around the user's neck. A clamp is movably coupled to the harness and the clamp may be positionable at a selected angle with respect to the user's chest. The clamp may engage an extrinsic electronic device. Thus, the extrinsic electronic device may be positioned at an accessible location with respect to the user.

11 Claims, 5 Drawing Sheets

ELECTRONIC DEVICE HARNESS ASSEMBLY

BACKGROUND OF THE DISCLOSURE

Field of the Disclosure

The disclosure relates to harness devices and more particularly pertains to a new harness device for facilitating hands free use of an electronic device.

SUMMARY OF THE DISCLOSURE

An embodiment of the disclosure meets the needs presented above by generally comprising a yoke that may be placed around a neck of a user. A harness is movably coupled to the yoke. The harness may be positioned on a chest of the user when the yoke is worn around the user's neck. A clamp is movably coupled to the harness and the clamp may be positionable at a selected angle with respect to the user's chest. The clamp may engage an extrinsic electronic device. Thus, the extrinsic electronic device may be positioned at an accessible location with respect to the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
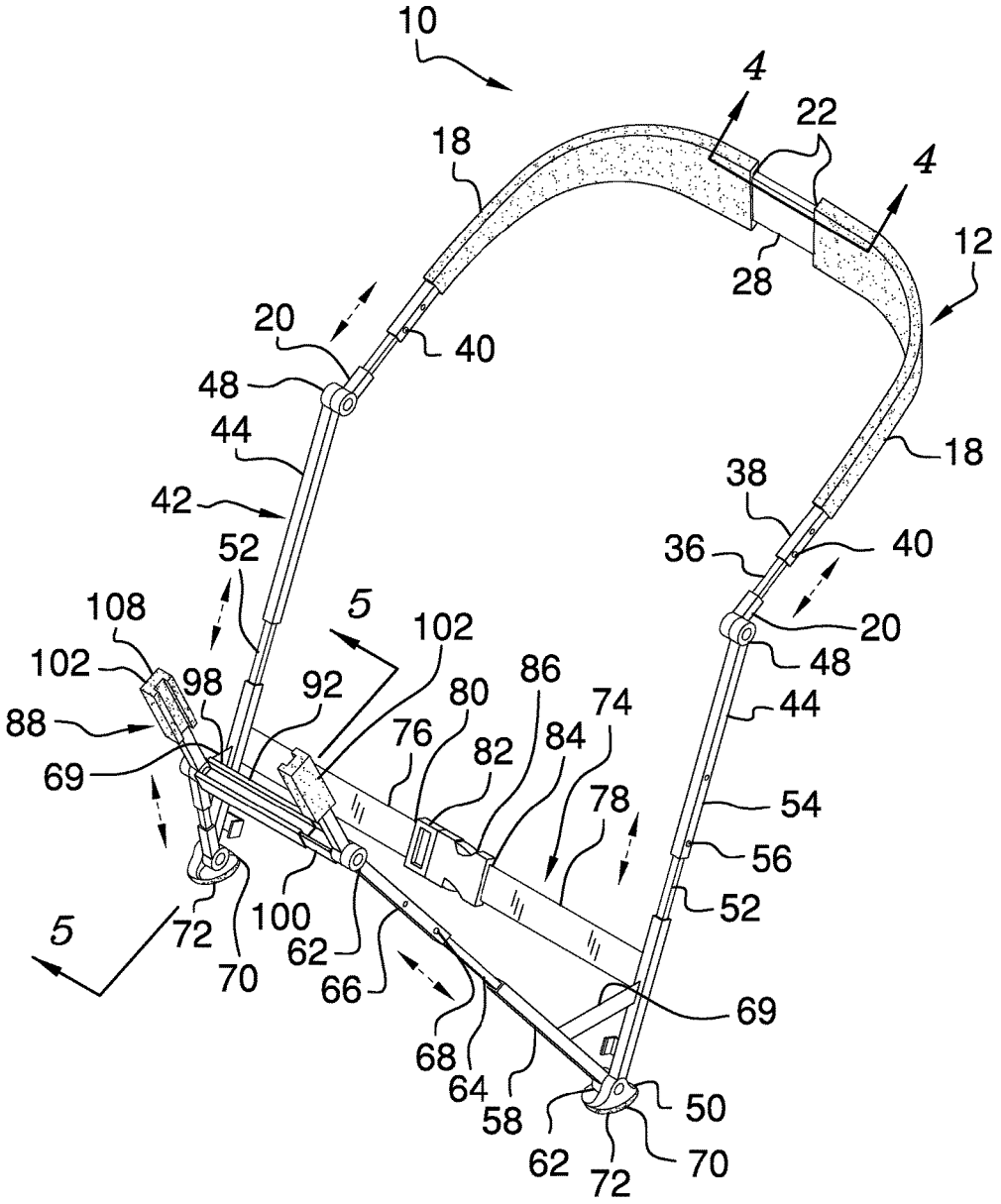
FIG. 1 is a front perspective view of an electronic device harness assembly according to an embodiment of the disclosure.
Figure 2:
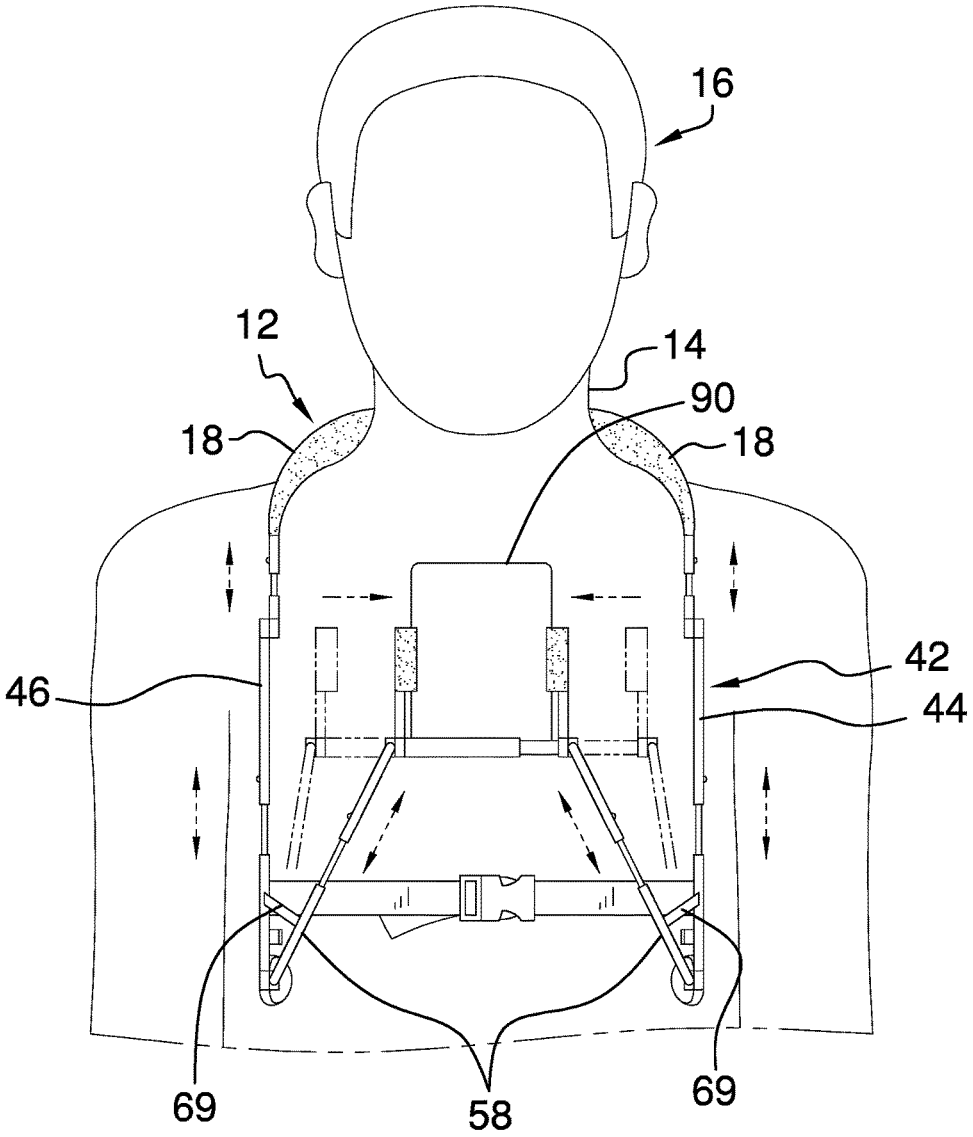
FIG. 2 is a front in-use view of an embodiment of the disclosure.
Figure 3:
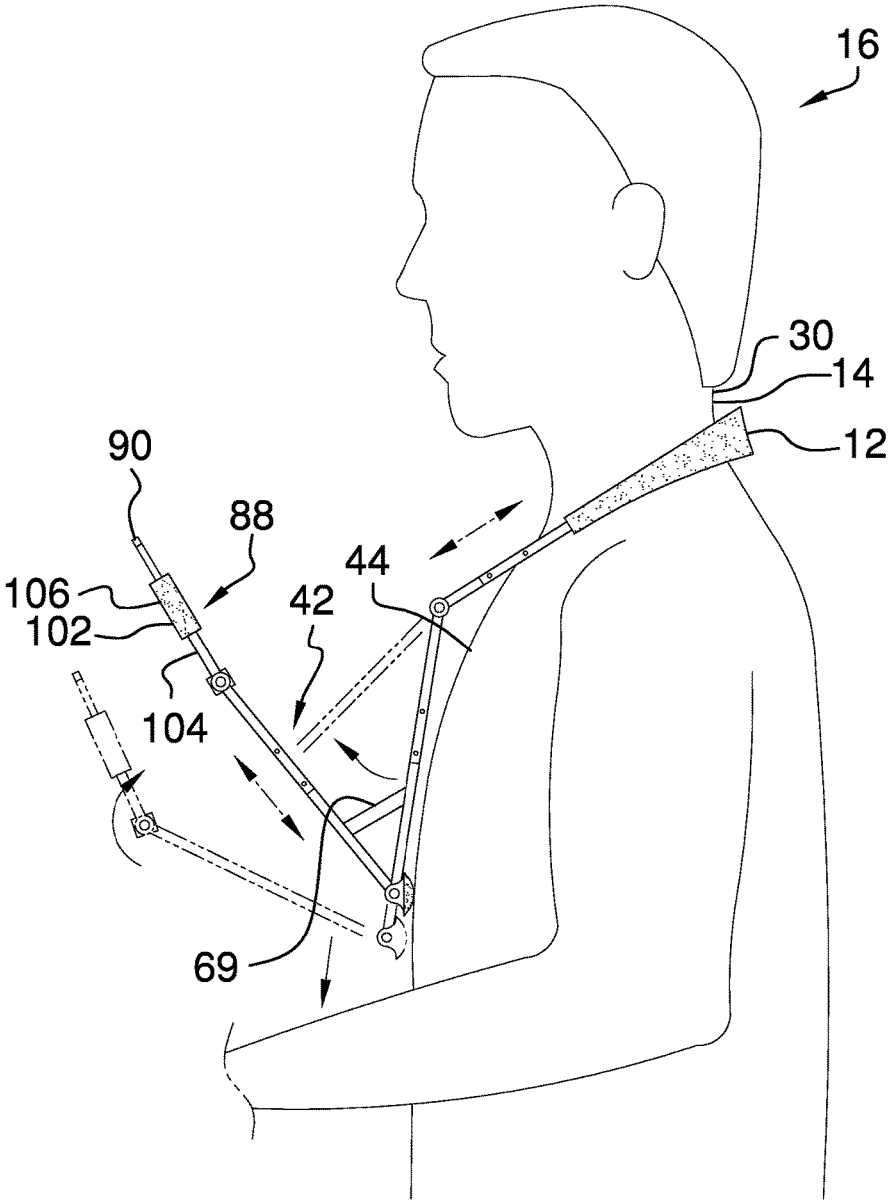
FIG. 3 is a left side in-use view of an embodiment of the disclosure.
Figure 4:
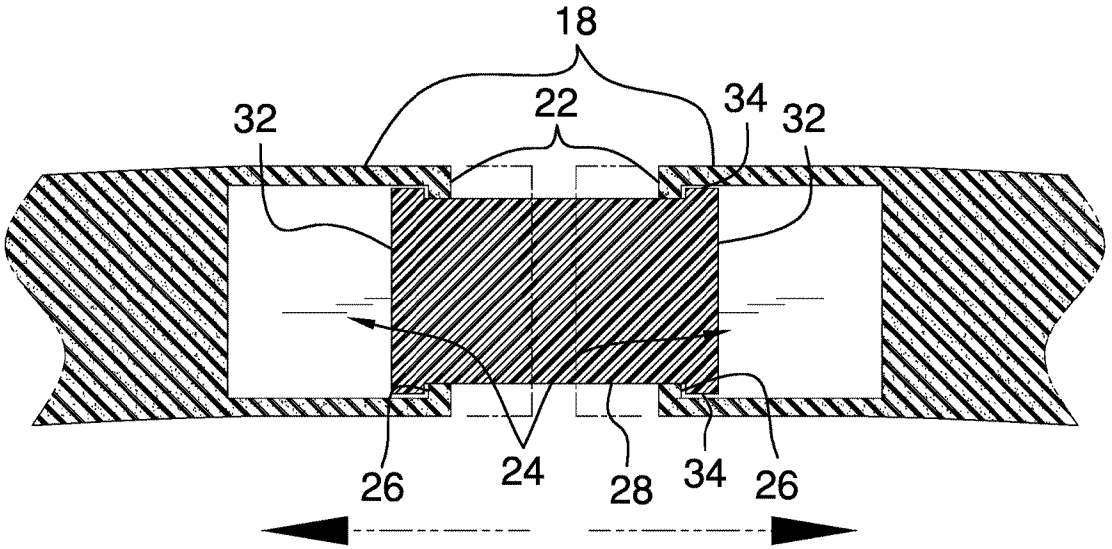
FIG. 4 is a cross sectional view taken along line 4-4 of FIG. 1 of an embodiment of the disclosure.
Figure 5:
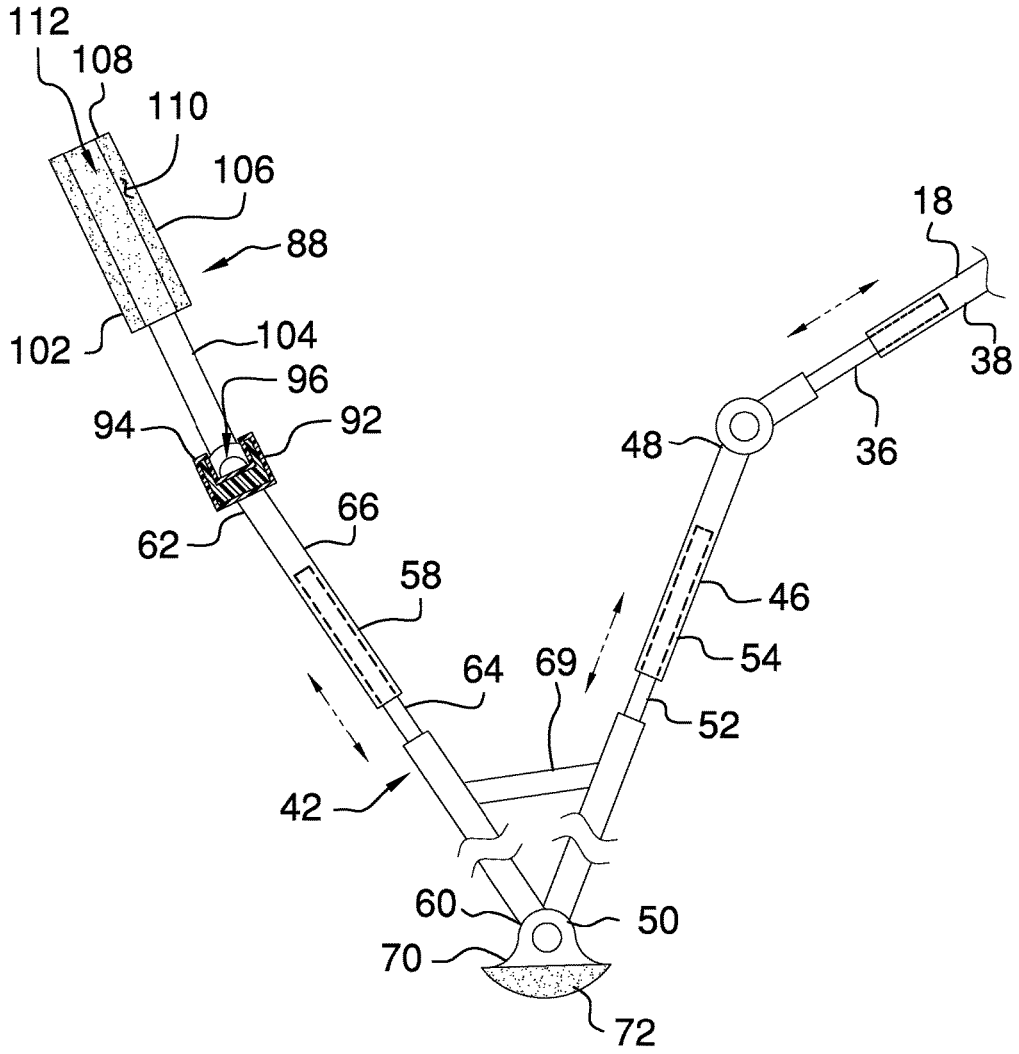
FIG. 5 is a cross sectional view taken along line 5-5 of FIG. 1 of an embodiment of the disclosure.

With reference now to the drawings, and in particular to FIGS. 1 through 5 thereof, a new harness device embodying the principles and concepts of an embodiment of the disclosure and generally designated by the reference numeral 10 will be described.

As best illustrated in FIGS. 1 through 5, the electronic device harness assembly 10 generally comprises a yoke 12 that may be placed around a neck 14 of a user 16. The yoke 12 comprises a pair of arms 18, and each of the arms 18 has a first end 20 and a second end 22. Each of the arms 18 is curved between the first end 20 and the second end 22 such that the second end 22 of each of the arms 18 is directed toward each other. The second end 22 corresponding to each of the arms 18 is open to define a well 24 in each of the arms 18. The well 24 in each of the arms 18 has an initial surface 26. Each of the arms 18 may be positioned on opposite sides of the user's neck 14.

A central member 28 is slidably coupled between the pair of arms 18. The central member 28 extends into the second end 22 of each of the arms 18. Thus, the arms 18 are positionable a selected distance apart from each other. The central member 28 may extend along a back 30 of the user's neck 14. Each of the arms 18 may be substantially comprised of a resiliently compressible material thereby enhancing comfort of the yoke 12. Moreover, each of the arms 18 may flare outwardly between the first end 20 and said the second end 22.

The central member 28 has a pair of ends 32. A pair of tabs 34 each extends outwardly from an associated one of the ends 32 corresponding to the central member 28. Each of the tabs 34 on each end 32 of the central member 28 selectively engages the initial surface 26 of a corresponding well 24. Thus, the central member 28 is inhibited from being removed from the arms 18.

Each of the arms 18 has a first portion 36 that is slidably coupled to a second portion 38. Thus, the first end 20 corresponding to each of the arms 18 is extendable a selected distance away from the central member 28. Each of the arms 18 may include a first lock 40. The first lock 40 may be coupled to the first portion 36 of a corresponding arm 18. The first lock 40 may selectively engage the second portion 38 of the corresponding arm 18. Thus, each of the arms 18 may be retained at a selected length.

A harness 42 is movably coupled to the yoke 12 and the harness 42 may be positioned on a chest 44 of the user 16 when the yoke 12 is worn around the user's neck 14. The harness 42 comprises a pair of first rods 46, and each of the first rods 46 has a primary end 48 and a secondary end 50. Each of the first rods 46 has a central section 52 that is slidably coupled between the primary end 48 and the secondary end 50 of a corresponding to each of the first rods 46. Thus, each of the first rods 46 has a telescopically adjustable length. The primary end 48 of each of the first rods 46 is hingedly coupled to the first end 20 of a corresponding one of the pair of arms 18. Each of the first rods 46 may extend downwardly along the user's chest 44.

Each of the first rods 46 includes an upper portion 54. Each of the first rods 46 may include a second lock 56. The second lock 56 may be coupled to the central section 52 of a corresponding first rod 46. The second lock 56 may engage the upper portion 54 of the corresponding arm 18. Thus, the corresponding first rod 56 may be retained at a selected length.

A pair of second rods 58 is provided, and each of the second rods 58 has a beginning end 60 and a terminal end 62. Each of the second rods 58 has a medial section 64 that is slidably coupled between the beginning end 60 and the terminal end 62. Thus, each of the second rods 58 has a telescopically adjustable length. The beginning end 60 of each of the second rods 58 is hingedly coupled to the secondary end 50 of a corresponding one of the first rods 46. Each of the second rods 58 may be positioned at a selected angle with respect to the user's chest 44.

Each of the second rods 58 has a top section 66. Each of the second rods 58 may include a third lock 68. The third lock 68 may be positioned on the medial section 64 of a corresponding second rod 58. The third lock 68 may engage the top section 66 of the corresponding second rod 58. Thus, the corresponding second rod 58 may be retained at the selected length.

A pair of straps 69 may be provided. Each of the straps 69 may extend between a corresponding first rod 46 and an associated one of the second rods 58. Each of the straps 69 may retain each of the first rods 46 at a ninety degree angle with respect to the second rods 58 when the straps 69 are fully extended between the first rods 46 and the second rods 58. Each of the first rods 46 may frictionally engage the associated strap 69 at a selected location along each of the straps 69. Thus, each of the first rods 46 may be retained at a forty five degree angle and a sixty degree angle with respect to the associated second rod 58. Each of the first rods 46 may engage the associated strap 69 with a hook or the like.

A pair of feet 70 is provided and each of the feet 70 is hingedly coupled to the harness 42. Each of the feet 70 is positioned at an intersection of an associated pair of the first rod 46 and the second rod 58. Thus, each of the feet 70 may engage the user's chest 44. Each of the feet 70 includes a pad 72 and the pad 72 may abut the user's chest 44. The pad 72 corresponding to each of the feet 70 may be comprised of a resiliently compressible material. Thus, the pad 72 enhances comfort of the feet 70.

A belt 74 is provided that has a first half 76 and a second half 78. Each of the first half 76 and the second half 78 is coupled to an associated one of the second rods 58. The belt 74 is positioned closer to the terminal end 62 than the beginning end 60. The first half 76 is selectively matable to the second half 78.

The first half 76 has a distal end 80 with respect to the associated second rod 58. A buckle 82 may be coupled to the distal end 70 of the first half 76. The second half 78 has a distal end 84 with respect to the associated second rod 58. A clip 86 may be coupled to the distal end 84 of the second half 78. The buckle 82 may selectively engage the clip 86 thereby removably coupling the first half 76 to the second half 78. The belt 74 retains the second rods 85 a selected distance apart from each other.

A clamp 88 is movably coupled to the harness 42 and the clamp 88 may be positionable at a selected angle with respect to the user's chest 44. The clamp 88 may engage an extrinsic electronic device 90. Thus, the extrinsic electronic device 90 may be positioned at an accessible location with respect to the user 16. The extrinsic electronic device 90 may comprise a smart phone or the like.

The clamp 88 comprises a medial member 92 that is coupled between the terminal end 62 of each of the second rods 58. The medial member 92 has an upper surface 94 and the upper surface 94 has a groove 96 extending downwardly therein. Thus, the groove 96 may engage a lower edge of the extrinsic electronic device 90. The groove 96 is coextensive with the medial member 92. The medial member 92 includes a first half 98 that is slidably coupled to a second half 100. Thus, the medial member 92 has a telescopically adjustable width. The terminal end 62 of each of the second rods 58 may be spaced a selected distance apart from each other.

A pair of grips 102 is provided and each of the grips 102 is hingedly coupled to the terminal end 62 of an associated one of the second rods 58. Each of the grips 102 is positionable at a selected angle with respect to the associated second rod 58. Moreover, each of the grips 102 frictionally engages the associated second rod 58 at the selected angle. Thus, each of the grips 102 may be frictionally retained at a forty five degree angle, a sixty degree angle and a ninety degree angle with respect to the associated second rod 58.

Each of the grips 102 comprises a lower portion 104 and an upper portion 106. The upper portion 106 corresponding to each of the grips 102 has a distal end 108 with respect to the lower portion 104. Additionally, the upper portion 106 corresponding to each of the grips 102 has an inwardly facing surface 110. The inwardly facing surface 110 corresponding to each of the grips 102 is directed toward each other.

The inwardly facing surface 110 corresponding to each of the grips 102 has a channel 112 extending outwardly therein. The channel 112 extends between the lower portion 104 and the distal end 108 of the grips 102. The channel 112 in each of the grips 102 may engage an associated lateral edge of the extrinsic electronic device 90. Thus, the extrinsic electronic device 90 may be retained in the clamp 88. The upper portion 106 corresponding to each of the grips 102 may be comprised of a resiliently compressible material thereby enhancing gripping the extrinsic electronic device 90.

In use, yoke 12 is worn around the user's neck 14 and the yoke 12 is manipulated to a selected width. The first half 76 of the belt 74 is mated to the second half 78 of the belt 74. The lower edge of the extrinsic electronic device 90 is positioned in the groove 96 of the medial member 92. Each of the grips 102 is manipulated such that the channel 112 in each of the grips 102 engages the associated lateral edge of the extrinsic electronic device 90. Thus, the extrinsic electronic device 90 is retained in the clamp 88. Each of the harness 42 and the clamp 88 are manipulated to position the extrinsic electronic device 90 at a selected orientation with respect to the user 16. Thus, harness 42 and the clamp 88 facilitate hands free use of the extrinsic electronic device 90.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electronic device harness assembly configured to facilitate hands free use of the electronic device, said assembly comprising:

a yoke being configured to be placed around a neck of a user;

a harness being movably coupled to said yoke wherein said harness is configured to be positioned on a chest of the user when said yoke is worn around the user's neck, said harness comprising a pair of first rods and a pair of second rods, each of said second rods having a terminal end; and a clamp being movably coupled to said harness wherein said clamp is configured to be positionable at a selected angle with respect to the user's chest, said clamp being configured to engage an extrinsic electronic device thereby facilitating the extrinsic electronic device to be positioned at an accessible location with respect to the user, said clamp comprising a medial member being coupled between said terminal end of each of said second rods, said medial member having an upper surface, said upper surface having a groove extending downwardly therein wherein said groove is configured to engage a lower side of the extrinsic electronic device, said groove being coextensive with said medial member.

2. The assembly according to claim 1, wherein said yoke comprises a pair of arms, each of said arms having a first end and a second end, each of said arms being curved between said first end and said second end such that said second end of each of said arms is directed toward each other, said second end corresponding to each of said arms being open, each of said arms being configured to be positioned on opposite sides of the user's neck.

3. The assembly according to claim 1, wherein said medial member includes a first half being slidably coupled to a second half such that said medial member has a telescopically adjustable width having said terminal end of each of said second rods being spaced a selected distance apart from each other.

4. The assembly according to claim 1, further comprising a pair of grips, each of said grips being hingedly coupled to said terminal end of an associated one of said second rods, each of said grips comprising a lower portion and an upper portion, said upper portion corresponding to each of said grips having a distal end with respect to said lower portion and an inwardly facing surface, said inwardly facing surface corresponding to each of said grips being directed toward each other.

5. The assembly according to claim 4, wherein said inwardly facing surface corresponding to each of said grips has a channel extending outwardly therein, said channel extending between said lower portion and said distal end wherein said channel in each of said grips is configured to engage an associated lateral edge of the extrinsic electronic device thereby facilitating the extrinsic electronic device to be retained in said clamp.

6. The assembly of claim 1, further comprising:

said yoke comprising:

a pair of arms, each of said arms having a first end and a second end, each of said arms being curved between said first end and said second end such that said second end of each of said arms is directed toward each other, said second end corresponding to each of said arms being open, each of said arms being configured to be positioned on opposite sides of the user's neck; and a central member being slidably coupled between said pair of arms, said central member extending into said second end of each of said arms such that said arms are positionable a selected distance apart from each other, said central member being configured to extend along a back of the user's neck, each of said arms having a first portion being slidably coupled to a second portion such that said first end corresponding to each of said arms is extendable a selected distance away from said central member;

said harness comprising:

each of said first rods having a primary end and a secondary end, each of said first rods having a central section being slidably coupled between said primary end and said secondary end of a corresponding to each of said first rods such that each of said first rods has a telescopically adjustable length, said primary end of each of said first rods being hingedly coupled to said first end of a corresponding one of said pair of arms, each of said first rods being configured to extend downwardly along the user's chest, each of said second rods having a beginning end, each of said second rods having a medial section being slidably coupled between said beginning end and said terminal end such that each of said second rods has a telescopically adjustable length, said beginning end of each of said rods being hingedly coupled to said secondary end of a corresponding one of said first rods wherein each of said second rods is configured to be positioned at a selected angle with respect to the user's chest, a pair of feet, each of said feet being hingedly coupled to said harness, each of said feet being positioned at an intersection of an associated pair of said first rod and said second rod wherein each of said feet is configured to abut the user's chest, and a belt having a first half and a second half, each of said first half and said second half being coupled to an associated one of said second rods, said belt being positioned closer to said terminal end than said beginning end, said first half being selectively matable to said second half; and said clamp comprising:

said medial member including a first half being slidably coupled to a second half such that said medial member has a telescopically adjustable width having said terminal end of each of said second rods being spaced a selected distance apart from each other, and a pair of grips, each of said grips being hingedly coupled to said terminal end of an associated one of said second rods, each of said grips comprising a lower portion and an upper portion, said upper portion corresponding to each of said grips having a distal end with respect to said lower portion and an inwardly facing surface, said inwardly facing surface corresponding to each of said grips being directed toward each other, said inwardly facing surface corresponding to each of said grips having a channel extending outwardly therein, said channel extending between said lower portion and said distal end wherein said channel in each of said grips is configured to engage an associated lateral edge of the extrinsic electronic device thereby facilitating the extrinsic electronic device to be retained in said clamp.

7. An electronic device harness assembly configured to facilitate hands free use of the electronic device, said assembly comprising:

a yoke being configured to be placed around a neck of a user, said yoke comprising a pair of arms, each of said arms having a first end and a second end, each of said arms being curved between said first end and said second end such that said second end of each of said arms is directed toward each other, said second end corresponding to each of said arms being open, each of said arms being configured to be positioned on opposite sides of the user's neck;

a harness being movably coupled to said yoke wherein said harness is configured to be positioned on a chest of the user when said yoke is worn around the user's neck;

a clamp being movably coupled to said harness wherein said clamp is configured to be positionable at a selected angle with respect to the user's chest, said clamp being configured to engage an extrinsic electronic device thereby facilitating the extrinsic electronic device to be positioned at an accessible location with respect to the user; and a central member being slidably coupled between said pair of arms, said central member extending into said second end of each of said arms such that said arms are positionable a selected distance apart from each other, said central member being configured to extend along a back of the user's neck, each of said arms having a first portion being slidably coupled to a second portion such that said first end corresponding to each of said arms is extendable a selected distance away from said central member.

8. An electronic device harness assembly configured to facilitate hands free use of the electronic device, said assembly comprising:

a yoke being configured to be placed around a neck of a user, said yoke comprising a pair of arms, each of said arms having a first end;

a harness being movably coupled to said yoke wherein said harness is configured to be positioned on a chest of the user when said yoke is worn around the user's neck, said harness comprising a pair of first rods, each of said first rods having a primary end and a secondary end, each of said first rods having a central section being slidably coupled between said primary end and said secondary end of a corresponding to each of said first rods such that each of said first rods has a telescopically adjustable length, said primary end of each of said first rods being hingedly coupled to said first end of a corresponding one of said pair of arms, each of said first rods being configured to extend downwardly along the user's chest; and a clamp being movably coupled to said harness wherein said clamp is configured to be positionable at a selected angle with respect to the user's chest, said clamp being configured to engage an extrinsic electronic device thereby facilitating the extrinsic electronic device to be positioned at an accessible location with respect to the user.

9. The assembly according to claim 8, further comprising a pair of second rods, each of said second rods having a beginning end and a terminal end, each of said second rods having a medial section being slidably coupled between said beginning end and said terminal end such that each of said second rods has a telescopically adjustable length, said beginning end of each of said rods being hingedly coupled to said secondary end of a corresponding one of said first rods wherein each of said second rods is configured to be positioned at a selected angle with respect to the user's chest.

10. The assembly according to claim 9, further comprising a pair of feet, each of said feet being hingedly coupled to said harness, each of said feet being positioned at an intersection of an associated pair of said first rod and said second rod wherein each of said feet is configured to abut the user's chest.

11. The assembly according to claim 9, further comprising a belt having a first half and a second half, each of said first half and said second half being coupled to an associated one of said second rods, said belt being positioned closer to said terminal end than said beginning end, said first half being selectively matable to said second half.

* * * * *